US007983394B2

(12) United States Patent
Kozaczek et al.

(10) Patent No.: US 7,983,394 B2
(45) Date of Patent: Jul. 19, 2011

(54) MULTIPLE WAVELENGTH X-RAY SOURCE

(75) Inventors: Krzysztof Kozaczek, Midway, UT (US); Sterling Cornaby, Springville, UT (US); Steven Liddiard, Springville, UT (US); Charles Jensen, American Fork, UT (US)

(73) Assignee: Moxtek, Inc., Orem, UT (US)

( * ) Notice: Subject to any disclaimer, the term of this patent is extended or adjusted under 35 U.S.C. 154(b) by 55 days.

(21) Appl. No.: 12/640,154

(22) Filed: Dec. 17, 2009

(65) Prior Publication Data

US 2011/0150184 A1 Jun. 23, 2011

(51) Int. Cl.
*H01J 35/30* (2006.01)
*H01J 35/06* (2006.01)
*H01J 35/08* (2006.01)

(52) U.S. Cl. ..... 378/138; 378/136; 378/137; 378/140; 378/143

(58) Field of Classification Search ..... 378/136–138, 378/140, 143
See application file for complete search history.

(56) References Cited

U.S. PATENT DOCUMENTS

| | | | |
|---|---|---|---|
| 1,276,706 | A | 5/1918 | Snook et al. |
| 1,881,448 | A | 10/1932 | Forde et al. |
| 1,946,288 | A | 2/1934 | Kearsley |
| 2,291,948 | A | 8/1942 | Cassen |
| 2,316,214 | A | 4/1943 | Atlee et al. |
| 2,329,318 | A | 9/1943 | Atlee et al. |
| 2,340,363 | A | 2/1944 | Atlee et al. |
| 2,502,070 | A | 3/1950 | Atlee et al. |
| 2,683,223 | A | 7/1954 | Hosemann |
| 2,952,790 | A | 9/1960 | Steen |
| 3,218,559 | A | 11/1965 | Applebaum |
| 3,356,559 | A | 12/1967 | Mohn et al. |
| 3,397,337 | A | 8/1968 | Denholm |
| 3,434,062 | A | 3/1969 | Cox |
| 3,538,368 | A | 11/1970 | Oess |
| 3,665,236 | A | 5/1972 | Gaines et al. |
| 3,679,927 | A | 7/1972 | Kirkendall |
| 3,691,417 | A | 9/1972 | Gralenski |
| 3,741,797 | A | 6/1973 | Chavasse, Jr. et al. |

(Continued)

FOREIGN PATENT DOCUMENTS

DE 10 30 936 5/1958

(Continued)

OTHER PUBLICATIONS

Chen, Xiaohua et al., "Carbon-nanotube metal-matrix composites prepared by electroless plating," Composites Science and Technology, 2000, pp. 301-306, vol. 60.

(Continued)

*Primary Examiner* — Edward J Glick
*Assistant Examiner* — Thomas R Artman
(74) *Attorney, Agent, or Firm* — Thorpe North & Western LLP

(57) ABSTRACT

A multiple wavelength x-ray source includes a multi-thickness target, having at least a first and a second thickness. The first thickness can substantially circumscribe the second thickness. An electron beam can be narrowed to impinge primarily upon second thickness or expanded to impinge primarily upon the first thickness while maintaining a constant direction of the beam. This invention allows the target thickness to be optimized for the desired output wavelength without the need to redirect or realign the x-rays towards the target.

21 Claims, 10 Drawing Sheets

U.S. PATENT DOCUMENTS

| | | | | |
|---|---|---|---|---|
| 3,751,701 | A | 8/1973 | Gralenski et al. | |
| 3,801,847 | A * | 4/1974 | Dietz | 378/125 |
| 3,828,190 | A | 8/1974 | Dahlin et al. | |
| 3,851,266 | A | 11/1974 | Conway | |
| 3,872,287 | A | 3/1975 | Kooman | |
| 3,882,339 | A * | 5/1975 | Rate et al. | 378/124 |
| 3,894,219 | A | 7/1975 | Weigel | |
| 3,962,583 | A | 6/1976 | Holland et al. | |
| 3,970,884 | A | 7/1976 | Golden | |
| 4,007,375 | A | 2/1977 | Albert | |
| 4,075,526 | A * | 2/1978 | Grubis | 378/124 |
| 4,160,311 | A | 7/1979 | Ronde et al. | |
| 4,178,509 | A | 12/1979 | More et al. | |
| 4,184,097 | A | 1/1980 | Auge | |
| 4,293,373 | A | 10/1981 | Greenwood | |
| 4,368,538 | A | 1/1983 | McCorkle | |
| 4,393,127 | A | 7/1983 | Greschner et al. | |
| 4,421,986 | A | 12/1983 | Friauf et al. | |
| 4,443,293 | A | 4/1984 | Mallon et al. | |
| 4,463,338 | A | 7/1984 | Utner et al. | |
| 4,521,902 | A | 6/1985 | Peugeot | |
| 4,532,150 | A | 7/1985 | Endo et al. | |
| 4,573,186 | A | 2/1986 | Reinhold | |
| 4,576,679 | A | 3/1986 | White | |
| 4,584,056 | A | 4/1986 | Perret et al. | |
| 4,591,756 | A | 5/1986 | Avnery | |
| 4,608,326 | A | 8/1986 | Neukermans et al. | |
| 4,645,977 | A | 2/1987 | Kurokawa et al. | |
| 4,675,525 | A | 6/1987 | Amingual et al. | |
| 4,679,219 | A | 7/1987 | Ozaki | |
| 4,688,241 | A * | 8/1987 | Peugeot | 378/137 |
| 4,696,994 | A | 9/1987 | Nakajima et al. | |
| 4,705,540 | A | 11/1987 | Hayes | |
| 4,777,642 | A | 10/1988 | Ono | |
| 4,797,907 | A | 1/1989 | Anderton | |
| 4,818,806 | A | 4/1989 | Kunimune et al. | |
| 4,819,260 | A | 4/1989 | Haberrecker | |
| 4,862,490 | A | 8/1989 | Karnezos et al. | |
| 4,870,671 | A | 9/1989 | Hershyn | |
| 4,876,330 | A | 10/1989 | Higashi et al. | |
| 4,878,866 | A | 11/1989 | Mori et al. | |
| 4,885,055 | A | 12/1989 | Woodbury et al. | |
| 4,933,557 | A | 6/1990 | Perkins | |
| 4,939,763 | A | 7/1990 | Pinneo et al. | |
| 4,957,773 | A | 9/1990 | Spencer et al. | |
| 4,960,486 | A | 10/1990 | Perkins et al. | |
| 4,969,173 | A * | 11/1990 | Valkonet | 378/136 |
| 4,979,198 | A | 12/1990 | Malcolm et al. | |
| 4,979,199 | A | 12/1990 | Cueman et al. | |
| 5,010,562 | A | 4/1991 | Hernandez et al. | |
| 5,063,324 | A | 11/1991 | Grunwald | |
| 5,066,300 | A | 11/1991 | Isaacson et al. | |
| 5,077,771 | A | 12/1991 | Skillicorn et al. | |
| 5,077,777 | A | 12/1991 | Daly | |
| 5,105,456 | A | 4/1992 | Rand et al. | |
| 5,117,829 | A | 6/1992 | Miller et al. | |
| 5,153,900 | A | 10/1992 | Nomikos et al. | |
| 5,161,179 | A | 11/1992 | Suzuki et al. | |
| 5,173,612 | A | 12/1992 | Imai et al. | |
| 5,178,140 | A | 1/1993 | Ibrahim | |
| 5,217,817 | A | 6/1993 | Verspui et al. | |
| 5,226,067 | A | 7/1993 | Allred et al. | |
| RE34,421 | E | 10/1993 | Parker et al. | |
| 5,258,091 | A | 11/1993 | Imai et al. | |
| 5,267,294 | A | 11/1993 | Kuroda et al. | |
| 5,302,523 | A | 4/1994 | Coffee et al. | |
| 5,343,112 | A | 8/1994 | Wegmann et al. | |
| 5,391,958 | A | 2/1995 | Kelly | |
| 5,392,042 | A | 2/1995 | Pellon | |
| 5,400,385 | A | 3/1995 | Blake et al. | |
| 5,428,658 | A | 6/1995 | Oettinger et al. | |
| 5,432,003 | A | 7/1995 | Plano et al. | |
| 5,469,429 | A | 11/1995 | Yamazaki et al. | |
| 5,469,490 | A | 11/1995 | Golden et al. | |
| 5,478,266 | A | 12/1995 | Kelly | |
| 5,521,851 | A | 5/1996 | Wei et al. | |
| 5,524,133 | A | 6/1996 | Neale et al. | |
| RE35,383 | E | 11/1996 | Miller et al. | |
| 5,571,616 | A | 11/1996 | Phillips et al. | |
| 5,578,360 | A | 11/1996 | Viitanen | |
| 5,602,507 | A | 2/1997 | Suzuki | |
| 5,607,723 | A | 3/1997 | Plano et al. | |
| 5,621,780 | A | 4/1997 | Smith et al. | |
| 5,627,871 | A * | 5/1997 | Wang | 378/121 |
| 5,631,943 | A | 5/1997 | Miles | |
| 5,680,433 | A * | 10/1997 | Jensen | 378/141 |
| 5,682,412 | A | 10/1997 | Skillicorn et al. | |
| 5,696,808 | A | 12/1997 | Lenz | |
| 5,729,583 | A | 3/1998 | Tang et al. | |
| 5,774,522 | A | 6/1998 | Warburton | |
| 5,812,632 | A | 9/1998 | Schardt et al. | |
| 5,835,561 | A | 11/1998 | Moorman et al. | |
| 5,870,051 | A | 2/1999 | Warburton | |
| 5,898,754 | A | 4/1999 | Gorzen | |
| 5,907,595 | A | 5/1999 | Sommerer | |
| 6,002,202 | A | 12/1999 | Meyer et al. | |
| 6,005,918 | A | 12/1999 | Harris et al. | |
| 6,044,130 | A | 3/2000 | Inazura et al. | |
| 6,062,931 | A | 5/2000 | Chuang et al. | |
| 6,063,629 | A | 5/2000 | Knoblauch | |
| 6,069,278 | A | 5/2000 | Chuang | |
| 6,075,839 | A | 6/2000 | Treseder | |
| 6,097,790 | A | 8/2000 | Hasegawa et al. | |
| 6,129,901 | A | 10/2000 | Moskovits et al. | |
| 6,133,401 | A | 10/2000 | Jensen | |
| 6,134,300 | A | 10/2000 | Trebes et al. | |
| 6,184,333 | B1 | 2/2001 | Gray | |
| 6,205,200 | B1 | 3/2001 | Boyer et al. | |
| 6,277,318 | B1 | 8/2001 | Bower et al. | |
| 6,282,263 | B1 | 8/2001 | Arndt et al. | |
| 6,288,209 | B1 | 9/2001 | Jensen | |
| 6,307,008 | B1 | 10/2001 | Lee et al. | |
| 6,320,019 | B1 | 11/2001 | Lee et al. | |
| 6,351,520 | B1 | 2/2002 | Inazaru | |
| 6,385,294 | B2 | 5/2002 | Suzuki et al. | |
| 6,388,359 | B1 | 5/2002 | Duelli et al. | |
| 6,438,207 | B1 | 8/2002 | Chidester et al. | |
| 6,477,235 | B2 | 11/2002 | Chornenky et al. | |
| 6,487,272 | B1 * | 11/2002 | Kutsuzawa | 378/140 |
| 6,487,273 | B1 | 11/2002 | Takenaka et al. | |
| 6,494,618 | B1 | 12/2002 | Moulton | |
| 6,546,077 | B2 | 4/2003 | Chornenky et al. | |
| 6,567,500 | B2 | 5/2003 | Rother | |
| 6,645,757 | B1 | 11/2003 | Okandan et al. | |
| 6,646,366 | B2 | 11/2003 | Hell et al. | |
| 6,658,085 | B2 | 12/2003 | Sklebitz | |
| 6,661,876 | B2 | 12/2003 | Turner et al. | |
| 6,740,874 | B2 | 5/2004 | Doring | |
| 6,778,633 | B1 | 8/2004 | Loxley et al. | |
| 6,799,075 | B1 | 9/2004 | Chornenky et al. | |
| 6,803,570 | B1 | 10/2004 | Bryson, III et al. | |
| 6,816,573 | B2 | 11/2004 | Hirano et al. | |
| 6,819,741 | B2 | 11/2004 | Chidester | |
| 6,838,297 | B2 | 1/2005 | Iwasaki | |
| 6,852,365 | B2 | 2/2005 | Smart et al. | |
| 6,866,801 | B1 | 3/2005 | Mau et al. | |
| 6,876,724 | B2 | 4/2005 | Zhou et al. | |
| 6,900,580 | B2 | 5/2005 | Dai et al. | |
| 6,956,706 | B2 | 10/2005 | Brandon | |
| 6,962,782 | B1 | 11/2005 | Livache et al. | |
| 6,976,953 | B1 | 12/2005 | Pelc | |
| 6,987,835 | B2 | 1/2006 | Lovoi | |
| 7,035,379 | B2 | 4/2006 | Turner et al. | |
| 7,046,767 | B2 | 5/2006 | Okada et al. | |
| 7,049,735 | B2 | 5/2006 | Ohkubo et al. | |
| 7,075,699 | B2 | 7/2006 | Oldham et al. | |
| 7,085,354 | B2 | 8/2006 | Kanagami | |
| 7,108,841 | B2 | 9/2006 | Smalley | |
| 7,110,498 | B2 | 9/2006 | Yamada | |
| 7,130,380 | B2 | 10/2006 | Lovoi et al. | |
| 7,130,381 | B2 | 10/2006 | Lovoi et al. | |
| 7,189,430 | B2 | 3/2007 | Ajayan et al. | |
| 7,203,283 | B1 | 4/2007 | Puusaari | |
| 7,206,381 | B2 | 4/2007 | Shimono et al. | |
| 7,215,741 | B2 | 5/2007 | Ukita | |
| 7,224,769 | B2 | 5/2007 | Turner | |
| 7,233,071 | B2 | 6/2007 | Furukawa et al. | |

| | | | | |
|---|---|---|---|---|
| 7,233,647 | B2 | 6/2007 | Turner et al. | |
| 7,286,642 | B2 | 10/2007 | Ishikawa et al. | |
| 7,305,066 | B2 * | 12/2007 | Ukita | 378/126 |
| 7,358,593 | B2 | 4/2008 | Smith et al. | |
| 7,382,862 | B2 | 6/2008 | Bard et al. | |
| 7,428,298 | B2 * | 9/2008 | Bard et al. | 378/138 |
| 7,448,801 | B2 | 11/2008 | Oettinger et al. | |
| 7,448,802 | B2 | 11/2008 | Oettinger et al. | |
| 7,486,774 | B2 | 2/2009 | Cain | |
| 7,526,068 | B2 | 4/2009 | Dinsmore | |
| 7,529,345 | B2 | 5/2009 | Bard et al. | |
| 7,618,906 | B2 | 11/2009 | Meilahti | |
| 7,634,052 | B2 | 12/2009 | Grodzins et al. | |
| 7,649,980 | B2 * | 1/2010 | Aoki et al. | 378/138 |
| 7,650,050 | B2 | 1/2010 | Haffner et al. | |
| 7,657,002 | B2 | 2/2010 | Burke et al. | |
| 7,675,444 | B1 | 3/2010 | Smith et al. | |
| 7,680,652 | B2 | 3/2010 | Giesbrecht et al. | |
| 7,693,265 | B2 | 4/2010 | Hauttmann et al. | |
| 7,709,820 | B2 | 5/2010 | Decker et al. | |
| 7,737,424 | B2 | 6/2010 | Xu et al. | |
| 7,756,251 | B2 | 7/2010 | Davis et al. | |
| 2002/0075999 | A1 | 6/2002 | Rother | |
| 2002/0094064 | A1 | 7/2002 | Zhou | |
| 2003/0152700 | A1 | 8/2003 | Asmussen et al. | |
| 2003/0165418 | A1 | 9/2003 | Ajayan et al. | |
| 2004/0076260 | A1 * | 4/2004 | Charles, Jr. et al. | 378/124 |
| 2005/0018817 | A1 | 1/2005 | Oettinger et al. | |
| 2005/0141669 | A1 | 6/2005 | Shimono et al. | |
| 2005/0207537 | A1 * | 9/2005 | Ukita | 378/125 |
| 2006/0073682 | A1 | 4/2006 | Furukawa et al. | |
| 2006/0098778 | A1 | 5/2006 | Oettinger et al. | |
| 2006/0233307 | A1 | 10/2006 | Dinsmore | |
| 2006/0269048 | A1 | 11/2006 | Cain | |
| 2007/0025516 | A1 * | 2/2007 | Bard et al. | 378/138 |
| 2007/0087436 | A1 | 4/2007 | Miyawaki et al. | |
| 2007/0111617 | A1 | 5/2007 | Meilahti | |
| 2007/0133921 | A1 | 6/2007 | Haffner et al. | |
| 2007/0142781 | A1 | 6/2007 | Sayre | |
| 2007/0107210 | A1 | 7/2007 | Nishide | |
| 2007/0165780 | A1 | 7/2007 | Durst et al. | |
| 2007/0183576 | A1 | 8/2007 | Burke et al. | |
| 2008/0199399 | A1 | 8/2008 | Chen et al. | |
| 2008/0296479 | A1 | 12/2008 | Anderson et al. | |
| 2008/0296518 | A1 | 12/2008 | Xu et al. | |
| 2008/0317982 | A1 | 12/2008 | Hecht | |
| 2009/0085426 | A1 | 4/2009 | Davis et al. | |
| 2009/0086923 | A1 | 4/2009 | Davis et al. | |
| 2009/0213914 | A1 | 8/2009 | Dong et al. | |
| 2009/0243028 | A1 | 10/2009 | Dong et al. | |
| 2010/0239828 | A1 | 9/2010 | Cornaby et al. | |
| 2010/0243895 | A1 | 9/2010 | Xu et al. | |
| 2010/0248343 | A1 | 9/2010 | Aten et al. | |
| 2010/0285271 | A1 | 11/2010 | Davis et al. | |
| 2010/0323419 | A1 | 12/2010 | Aten et al. | |

FOREIGN PATENT DOCUMENTS

| | | |
|---|---|---|
| DE | 44 30 623 | 3/1996 |
| DE | 19818057 | 11/1999 |
| EP | 0 297 808 | 1/1989 |
| EP | 0330456 | 8/1989 |
| GB | 1252290 | 11/1971 |
| JP | 57 082954 | 8/1982 |
| JP | 3170673 | 7/1991 |
| JP | 4-171700 | 6/1992 |
| JP | 5066300 | 3/1993 |
| JP | 5-135722 | 6/1993 |
| JP | 06 119893 | 7/1994 |
| JP | 6289145 | 10/1994 |
| JP | 08315783 | 11/1996 |
| JP | 2003211396 | 7/2003 |
| JP | 2006297549 | 11/2008 |
| KR | 1020050107094 | 11/2005 |
| WO | WO99/65821 | 12/1999 |
| WO | WO00/09443 | 2/2000 |
| WO | WO00/17102 | 3/2000 |
| WO | WO03/076951 | 9/2003 |
| WO | WO 2008/052002 | 5/2008 |
| WO | WO 2009/009610 | 1/2009 |
| WO | WO 2009/045915 | 4/2009 |
| WO | WO 2009/085351 | 7/2009 |
| WO | WO 2010/107600 | 9/2010 |

OTHER PUBLICATIONS

Flahaut, E. et al, "Carbon Nanotube-metal-oxide nanocomposites; microstructure, electrical conductivity and mechanical properties," Acta mater., 2000, pp. 3803-3812.Vo. 48.

Gevin et al., "IDeF-X V1.0: performances of a new CMOS multi channel analogue readout ASIC for Cd(Zn)Te detectors", IDDD, Oct. 2005, 433-437, vol. 1.

Grybos et al., "DEDIX—development of fully integrated multichannel ASCI for high count rate digital x-ray imaging systems", IEEE, 693-696, vol. 2. 2006.

Grybos et al., "Measurements of matching and high count rate performance of mulitchannel ASIC for digital x-ray imaging systems", IEEE, Aug. 2007, 1207-1215, vol. 54, Issue 4.

Grybos et al., "Pole-Zero cancellation circuit with pulse pile-up tracking system for low noise charge-sensitive amplifiers", Feb. 2008, 583-590, vol. 55, Issue 1.

http://www.orau.org/ptp/collectio/xraytubescollidge/MachlettCW250T.htm, 1999, 2 pages.

Hutchison, "Vertically aligned carbon nanotubes as a framework for microfabrication of high aspect ration mems," 2008, pp. 1-50.

Jiang, Linquin et al., "Carbon nanotubes-metal nitride composites; a new class of nanocomposites with enhanced electrical properties," J. Mater. Chem., 2005, pp. 260-266, vol. 15.

Li, Jun et al., "Bottom-up approach for carbon nanotube interconnects," Applied Physics Letters, Apr. 14, 2003, pp. 2491-2493, vol. 82 No. 15.

MA. R.Z., et al., "Processing and properties of carbon nanotubes-nano-SIC ceramic", Journal of Materials Science 1998, pp. 5243-5246, vol. 33.

Micro X-ray Tube Operation Manual, X-ray and Specialty Instruments Inc., 1996, 5 pages.

Panayiotatos, et al., "Mechanical performance and growth characteristics of boron nitride films with respect to their optical, compositional properties and density," Surface and Coatings Technology, 151-152 (2002) 155-159.

Peigney, et al., "Carbon nanotubes in novel ceramic matrix nanocomposites," Ceramics International, 2000, pp. 677-683, vol. 26.

Rankov et al., "A novel correlated double sampling poly-Si circuit for readout systems in large area x-ray sensors", IEEE, May 2005, 728-731, vol. 1.

Satishkumar B.C., et al. "Synthesis of metal oxide nanorods using carbon nanotubes as templates," Journal of Materials Chemistry, 2000, pp. 2115-2119, vol. 10.

Sheather, "The support of thin windows for x-ray proportional counters," Journal Phys,E., Apr. 1973, pp. 319-322, vol. 6, No. 4.

Tamura et al., "Development of ASICs for CdTe pixel and line sensors", Oct. 2005, 2023-2029, vol. 52, Issue 5.

Wagner et al., "Effects of scatter in dual-energy imaging: an alternative analysis", Sep. 1989, 236-244, vol. 8, Issue 3.

Winter, J., H. G. Esser, and H. Reimer, "Diborane-free boronization," Fusion Technol. 20, 225 (1991).

Yan, Xing-Bin, et al., Fabrications of Three-Dimensional ZnO-Carbon Nanotube (CNT) Hybrids Using Self-Assembled CNT Micropatterns as Framework, 2007, pp. 17254-17259, vol. III.

Anderson et al., U.S. Appl. No. 11/756,962, filed Jun. 1, 2007.

Barkan et al., "Improved window for low-energy x-ray transmission a Hybrid design for energy-dispersive microanalysis," Sep. 1995, 2 pages, Ectroscopy 10(7).

Blanquart et al.; "XPAD, a New Read-out Pixel Chip for X-ray Counting"; IEEE Xplore; Mar. 25, 2009.

Comfort, J. H., "Plasma-enhanced chemical vapor deposition of in situ doped epitaxial silicon at low temperatures," J. Appl. Phys. 65, 1067 (1989).

Das, D. K., and K. Kumar, "Chemical vapor deposition of boron on a beryllium surface," Thin Solid Films, 83(1), 53-60.

Das, K., and Kumar, K., "Tribological behavior of improved chemically vapor-deposited boron on a beryllium," Thin Solid Films, 108(2), 181-188.
Hanigofsky, J. A., K. L. More, and W. J. Lackey, "Composition and microstructure of chemically vapor-deposited boron nitride, aluminum nitride, and boron nitride + aluminum nitride composites," J. Amer. Ceramic Soc. 74, 301 (1991).
Komatsu, S., and Y. Moriyoshi, "Influence of atomic hydrogen on the growth reactions of amorphous boron films in a low-pressure B.sub.2 H.sub.6 +He+H.sub.2 plasma", J. Appl. Phys. 64, 1878 (1988).
Komatsu, S., and Y. Moriyoshi, "Transition from amorphous to crystal growth of boron films in plasma-enhanced chemical vapor deposition with B.sub.2 H.sub.6 +He," J. Appl. Phys., 66, 466 (1989).
Komatsu, S., and Y. Moriyoshi, "Transition from thermal-to electron-impact decomposition of diborane in plasma-enhanced chemical vapor deposition of boron films from B.sub.2 H.sub.6 +He," J. Appl. Phys. 66, 1180 (1989).
Lee, W., W. J. Lackey, and P. K. Agrawal, "Kinetic analysis of chemical vapor deposition of boron nitride," J. Amer. Ceramic Soc. 74, 2642 (1991).
Lines, U.S. Appl. No. 12/352,864, filed Jan. 13, 2009.
Lines, U.S. Appl. No. 12/726,120, filed Mar. 17, 2010.
Maya, L., and L. A. Harris, "Pyrolytic deposition of carbon films containing nitrogen and/or boron," J. Amer. Ceramic Soc. 73, 1912 (1990).
Michaelidis, M., and R. Pollard, "Analysis of chemical vapor deposition of boron," J. Electrochem. Soc. 132, 1757 (1985).
Moore, A. W., S. L. Strong, and G. L. Doll, "Properties and characterization of codeposited boron nitride and carbon materials," J. Appl. Phys. 65, 5109 (1989).
Nakamura, K., "Preparation and properties of amorphous boron nitride films by molecular flow chemical vapor deposition," J. Electrochem. Soc. 132, 1757 (1985).
PCT Application PCT/US08/65346; filed May 30, 2008; Keith Decker.
PCT Application PCT/US10/56011; filed Nov. 9, 2010; Krzysztof Kozaczek.
Perkins, F. K., R. A. Rosenberg, and L. Sunwoo, "Synchrotronradiation deposition of boron and boron carbide films from boranes and carboranes: decaborane," J. Appl. Phys. 69,4103 (1991).
Powell et al., "Metalized polyimide filters for x-ray astronomy and other applications," SPIE, pp. 432-440, vol. 3113.
Roca i Cabarrocas, P., S. Kumar, and B. Drevillon, "In situ study of the thermal decomposition of B.sub.2 H.sub.6 by combining spectroscopic ellipsometry and Kelvin probe measurements," J. Appl. Phys. 66, 3286 (1989).
Scholze et al., "Detection efficiency of energy-dispersive detectors with low-energy windows" X-Ray Spectrometry, X-Ray Spectrom, 2005: 34: 473-476.
Shirai, K., S.-I. Gonda, and S. Gonda, "Characterization of hydrogenated amorphous boron films prepared by electron cyclotron resonance plasma chemical vapor deposition method," J. Appl. Phys. 67, 6286 (1990).
Tamura, et al "Developmenmt of ASICs for CdTe Pixel and Line Sensors", IEEE Transactions on Nuclear Science, vol. 52, No. 5, Oct. 2005.
Tien-Hui Lin et al., "An investigation on the films used as teh windows of ultra-soft X-ray counters." Acta Physica Sinica, vol. 27, No. 3, pp. 276-83, May 1978, abstract only.
U.S. Appl. No. 12/640,154, filed Dec. 17, 2009; Krzysztof Kozaczek.
U.S. Appl. No. 12/726,120, filed Mar. 17, 2010; Michael Lines.
U.S. Appl. No. 12/783,707, filed May 20, 2010; Steven D. Liddiard.
U.S. Appl. No. 12/899,750, filed Oct. 7, 2010; Steven Liddiard.
U.S. Appl. No. 13/018,667, filed Feb. 1, 2011; Lei Pei.
Vandenbulcke, L. G., "Theoretical and experimental studies on the chemical vapor deposition of boron carbide," Indust. Eng. Chem. Prod. Res. Dev. 24, 568 (1985).
Viitanen Veli-Pekka et al., Comparison of Ultrathin X-Ray Window Designs, presented at the Soft X-rays in the 21st Century Conference held in Provo, utah Feb. 10-13, 1993, pp. 182-190.
www.moxtek.com, Moxtek, Sealed Proportional Counter X-Ray Windows, Oct. 2007, 3 pages.
www.moxtek.com, Moxtek, AP3 Windows, Ultra-thin Polymer X-Ray Windows, Sep. 2006, 2 pages.
www.moxtek.com, Moxtek, DuraBeryllium X-Ray Windows, May 2007, 2 pages.
www.moxtek.com, Moxtek, ProLine Series 10 Windows, Ultra-thin Polymer X-Ray Windows, Sep. 2006, 2 pages.
www.moxtek.com, X-Ray Windows, ProLINE Series 20 Windows Ultra-thin Polymer X-ray Windows, 2 pages. Applicant believes that this product was offered for sale prior to the filed of applicant's application.

* cited by examiner

MULTIPLE WAVELENGTH X-RAY SOURCE

BACKGROUND

X-ray tubes can include an electron source, such as a filament, which can emit an electron beam into an evacuated chamber towards an anode target. The electron beam causes the anode target material to emit elemental-specific, characteristic x-rays and Bremsstrahlung x-rays. X-rays emitted from the anode target material can impinge upon a sample. The sample can then emit elemental-specific x-rays. These sample emitted x-rays can be received and analyzed. Because each material emits x-rays that are characteristic of the elements in the material, the elements in the sample material can be identified.

The characteristic x-rays emitted from both the target and the sample can include K-lines and L-lines for K and L electron orbital atomic transitions respectively. The K-lines of a given element are higher in energy than the L-lines for that element. For quantification of the amount of an element in the sample, it is important that a K-line or an L-line in the anode target have a higher energy than a K-line or an L-line in the sample. It is also desirable for the K-line or the L-line in the anode target to have an energy relatively close to the K-line or L-line in the sample, in order to maximize the K-line or L-line x-ray signal from the sample, thus improving the accuracy and precision of analysis.

If an L-line from the x-ray tube's anode target is higher than and close to the energy of a K-line or L-line in the sample, then the anode target L-line can be used for identification and quantification of the elements in the sample and it is desirable that the x-ray tube emit more of the target L-line x-rays and less K-line x-rays. The energy of the electrons impinging the target can be reduced by changing the x-ray tube voltage, thus causing the target to emit more L-line x-rays and less or no K-line x-rays. Thus the x-ray tube can emit relatively more L-line x-rays and less K-line and Bremsstrahlung x-rays. If the electron energy, controlled by the tube voltage, is lower than the energy of the K-line of the target, the K-line will not be emitted.

If a K-line from the x-ray tube's anode target is higher and close to the energy of a K-line or L-line in the sample, then the anode target K-line can be used for identification and quantification of the material in the sample and it is desirable that the x-ray tube emit more of the target K-line x-rays. The x-ray tube voltage can be increased in order to cause the x-ray tube to emit relatively more K-line x-rays. Thus it is desirable to adjust the x-ray tube voltage depending on the material that is being analyzed.

In a transmission x-ray tube, the use of a single anode target for multiple x-ray tube voltages can result in non-optimal use of the electron beam. A higher tube voltage can produce a higher energy electron beam. A higher energy electron beam can penetrate deeper into an anode target material. If the target material is too thin, then some of the electrons pass through the anode target material. Electrons that pass through the target anode material do not result in x-ray production by the target material and the overall efficiency of the electron to x-ray conversion is reduced. This is detrimental to the analysis of the sample since a higher rate of x-ray production can improve the precision and accuracy of analysis and reduces the time of measurement.

A lower tube voltage can produce a lower energy electron beam. A lower energy electron beam will not penetrate as deeply into the target material as will a higher energy beam. If the target material is too thick, then some of the x-rays produced will be absorbed by the target anode material. Target absorbed x-rays are not emitted towards the sample. This is another inefficient use of the electron beam.

Inefficient use of the electron beam to create the desired x-rays is undesirable because a longer sampling time is then required for material analysis than if all the electrons were used for production of target emitted x-rays. Thus if the target anode material is optimized for use at high x-ray tube voltages, then when used at low x-ray tube voltages, some of the target x-rays will be absorbed by the target material. If the target material is optimized for use at low x-ray tube voltages, then when used at high x-ray tube voltages, some of the electron beam will pass through the target material without production of x-rays.

If the target material target is compromised at an intermediate thickness, then at low tube voltage, some target produced x-rays will be reabsorbed by the target material, but not as many as if the target material was optimized for high tube voltage. Also, at high tube voltage, some of the electron beam will pass through the target, but not as much as if the target material was optimized for low tube voltage. Thus there is a problem at both high and low tube voltages.

Multiple targets may be used for production of different wavelengths of x-rays. For example, see U.S. Pat. Nos. 4,870,671; 4,007,375, and Japanese Patent Nos. JP 5-135722 and JP 4-171700. One target may be optimized for one tube voltage and another target may be optimized for a different tube voltage. A problem with multiple targets can be that the x-rays emitted from one target can be directed to a different location than x-rays emitted from a different target. This can create problems for the user who may then need to realign the x-ray tube or tube optics each time a transition is made from one target to another target.

The need to realign the x-ray tube or tube optics may be overcome by use of a layered target, with each layer comprised of a different material. For example, see U.S. Pat. No. 7,203,283. A problem with a layered target can be that an x-ray spectrum emitted from a layered target can contain energy lines originating from all target layers making the analysis more cumbersome and less precise.

X-rays emitted from multiple targets can be directed by optics towards the sample material. For example, see U.S. Patent Publication No. 2007/0165780 and WIPO Publication No. WO 2008/052002. Additional optics can have the disadvantage of increased complexity and cost.

SUMMARY

It has been recognized that it would be advantageous to develop an x-ray source that optimally uses the electron beam when changing from one x-ray wavelength to another. It has also been recognized that it would be advantageous to develop an x-ray source that avoids the need to realign the x-ray tube or use optics to redirect the electron beam when changing from one x-ray wavelength to another.

The present invention is directed to a multiple wavelength x-ray source that satisfies the need for changing from one wavelength to another without x-ray tube alignment, without the need for additional optics to redirect the x-ray beam, and without loss of efficiency of the electron beam. The apparatus comprises an x-ray source comprising an evacuated tube, an anode coupled to the tube, and a cathode opposing the anode and also coupled to the tube. The anode includes a window with a target. The target has a material configured to produce X-rays in response to impact of electrons. The cathode includes an electron source configured to produce electrons which are accelerated towards the target in response to an electric field between the anode and the cathode, defining an electron beam. The target has an outer region substantially circumscribing an inner region. Either the inner or the outer region is thicker than the other region. The inner region is disposed substantially at the center of a desired path of the electron beam.

DETAILED DESCRIPTION

Figure 1:
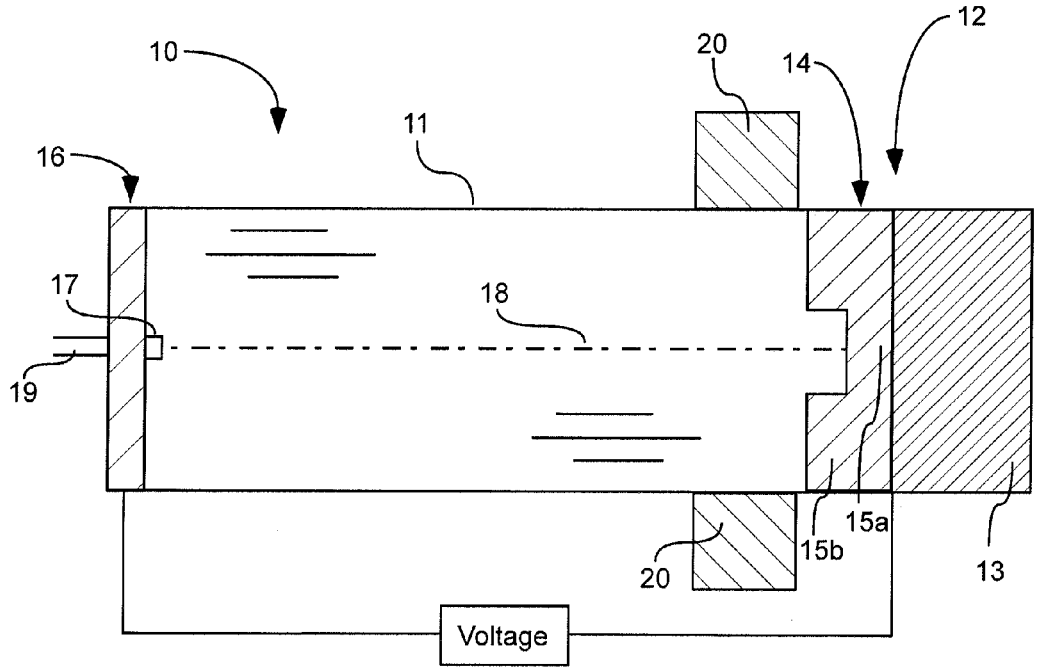
FIG. 1 is a schematic cross-sectional side view of a multiple wavelength x-ray source in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The multiple wavelength x-ray source 10, shown in FIG. 1 includes an evacuated tube 11, an anode 12 coupled to the tube, and a cathode 16, opposing the anode and also coupled to the tube 11. The anode 12 includes an x-ray transparent window 13 and a target 14. Although FIG. 1 shows the target 14 having a thickness that is similar to a thickness of the window 13, typically the window 13 is much thicker than the target 14. A relatively thicker target 14 is shown in order to aid in showing features of the target, such as an inner region 15*a* of the target and an outer region of the target 15*b*, wherein one region is thicker than the other region, defining a thicker region and a thinner region. The cathode 16 includes at least one electron source 17 which is configured to produce electrons accelerated towards the target 14, in response to an electric field between the anode 12 and the cathode 16, defining an electron beam. The electron source 17 can be a filament. The target 14 is comprised of a material configured to produce x-rays in response to impact of electrons. The multiple wavelength x-ray source 10 also includes a means for expanding and narrowing an electron beam while maintaining a center or direction 18 of the electron beam in substantially the same location.

Figure 2:
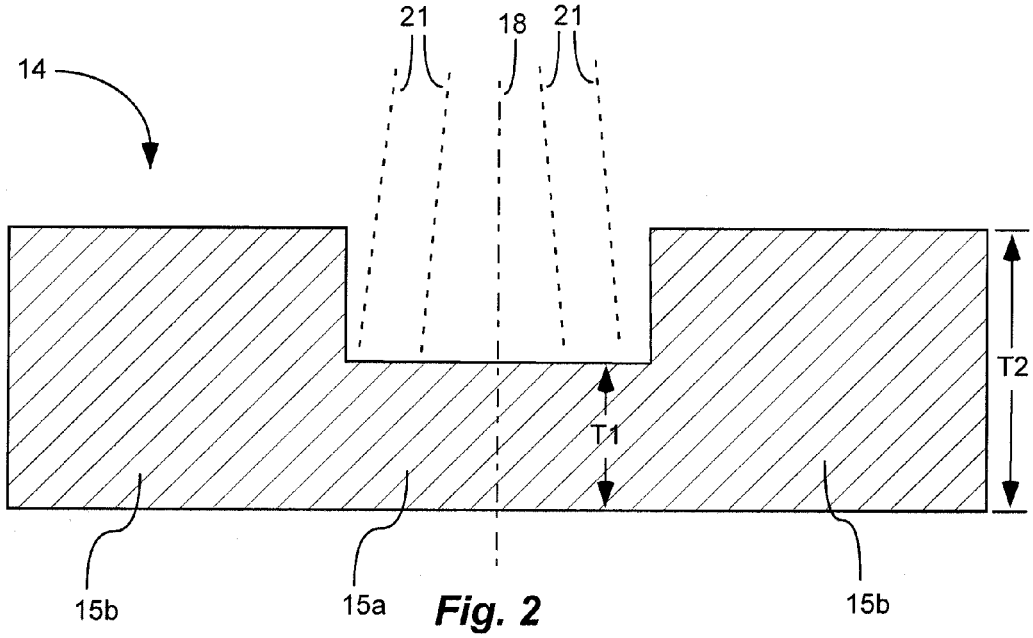
FIG. 2 is a schematic cross-sectional side view of a multiple thickness target in accordance with an embodiment of the present invention.
Figure 3:
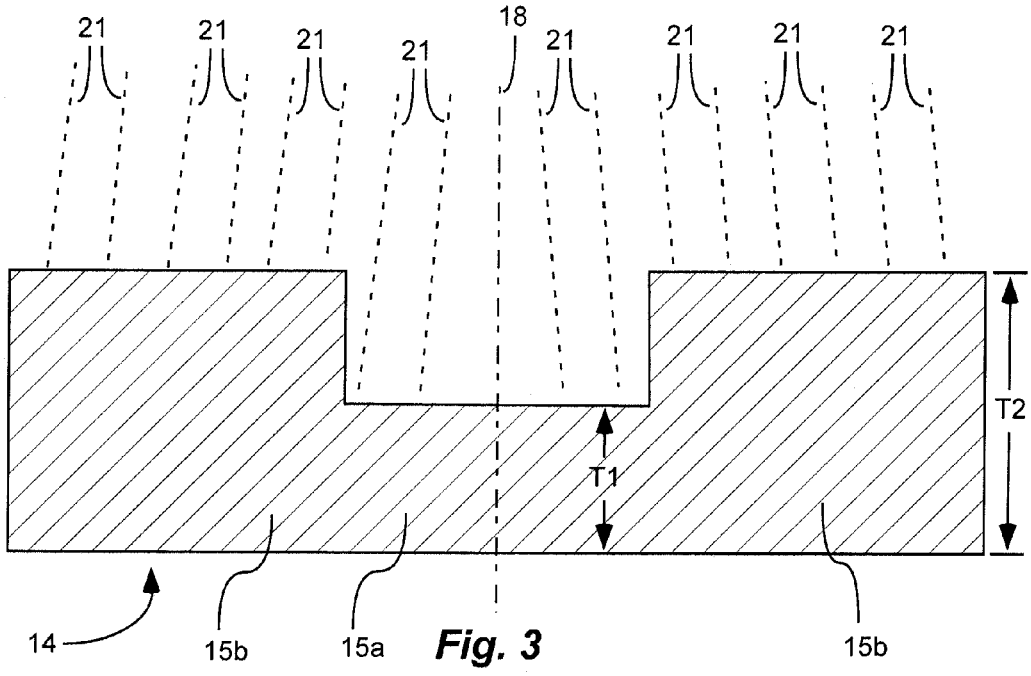
FIG. 3 is a schematic cross-sectional side view of a multiple thickness target in accordance with an embodiment of the present invention.
Figure 4:
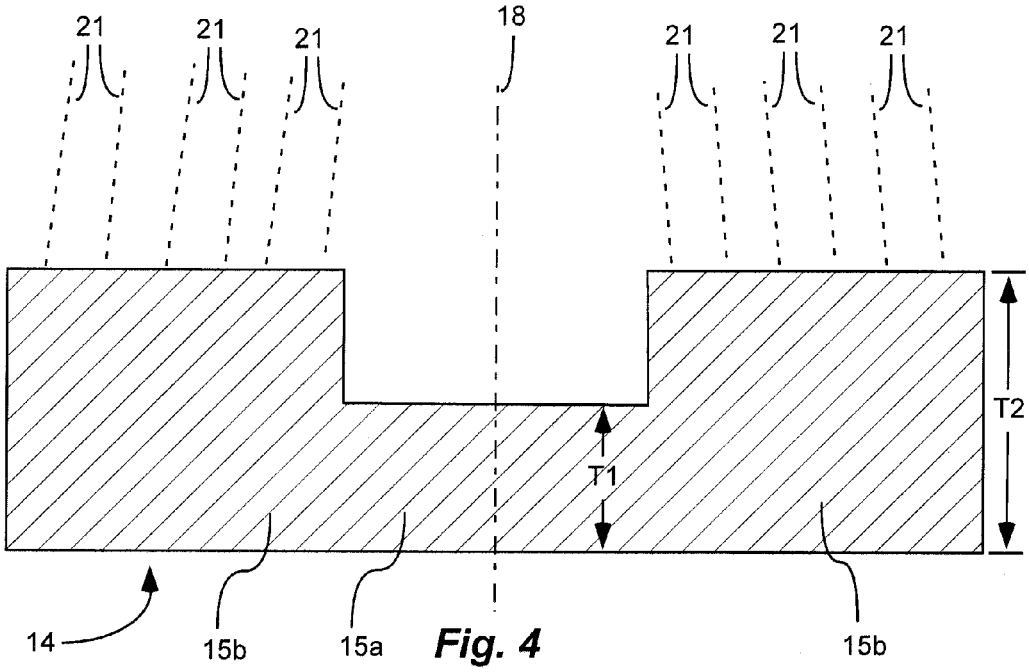
FIG. 4 is a schematic cross-sectional side view of a multiple thickness target in accordance with an embodiment of the present invention.

As shown in FIG. 2, an electron beam 21 can be narrowed in order to impinge mostly upon the inner region 15*a* of the target 14. As shown in FIG. 3, the electron beam 21 can be expanded in order to impinge upon substantially the entire target region. The area of the outer region can be significantly greater than the area of the inner region such that when the electron beam 21 is expanded to impinge upon the entire target region, only a small fraction of the electron beam 21 will actually impinge upon the inner region. As shown in FIG. 4, depending on the means selected for expanding the electron beam 21, the electron beam can be significantly stronger in the outer region or perimeter of the electron beam and significantly weaker in the central region of the electron beam such that only a very minimal portion of the electron beam will impinge on the inner region 15*a* of the target when the electron beam is expanded.

Figure 5:
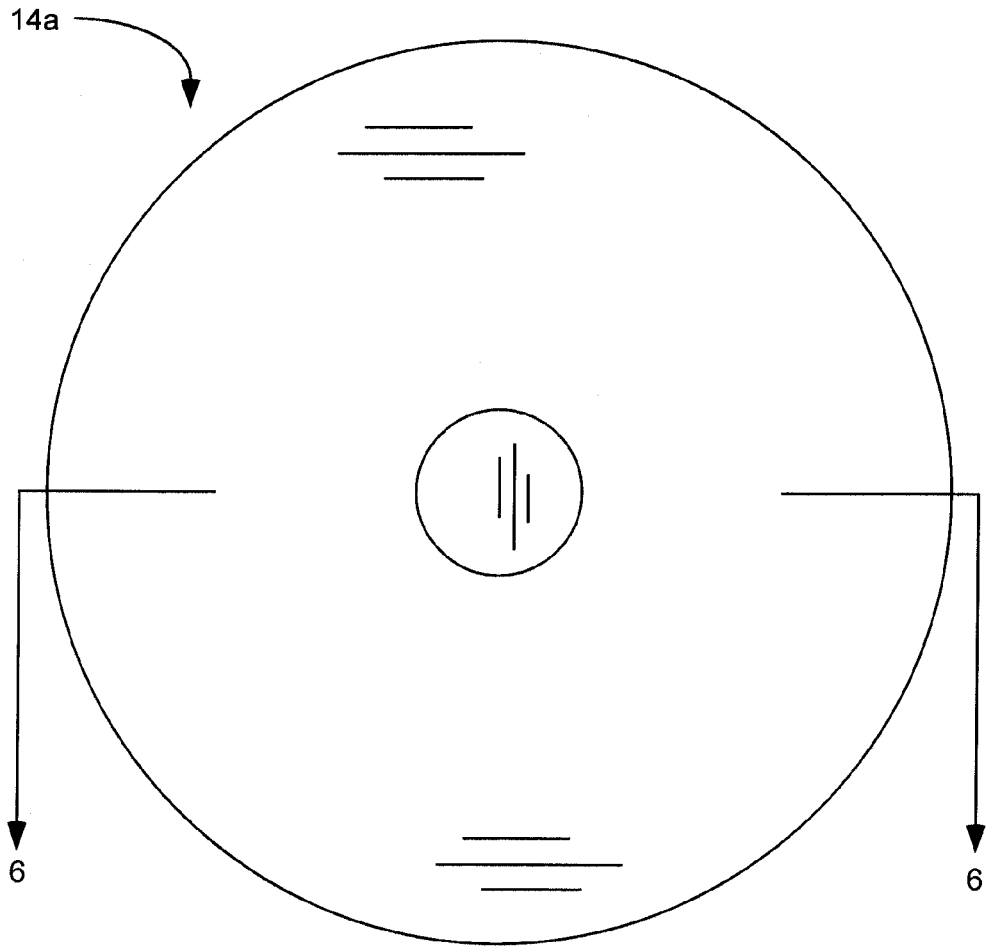
FIG. 5 is a schematic top view of a multiple thickness target in accordance with an embodiment of the present invention.
Figure 6:
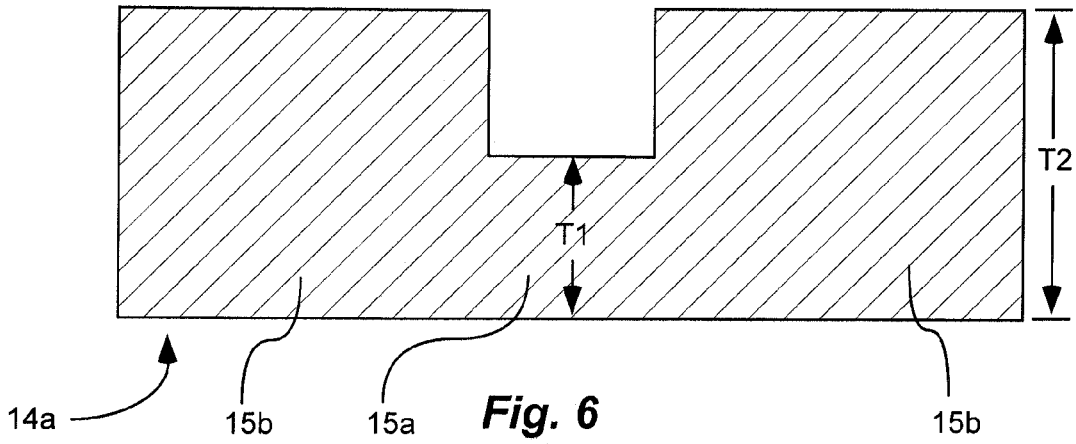
FIG. 6 is a schematic cross-sectional side view of the multiple thickness target of FIG. 5 taken along line 6-6 in FIG. 5.
Figure 7:
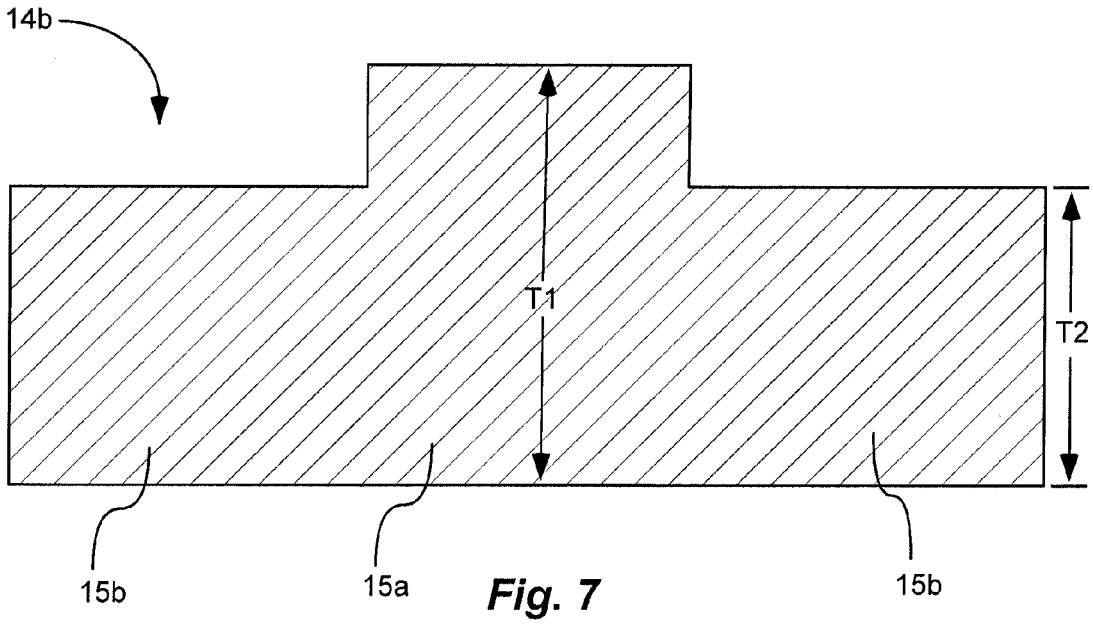
FIG. 7 is a schematic cross-sectional side view of a multiple thickness target in accordance with an embodiment of the present invention.
Figure 8:
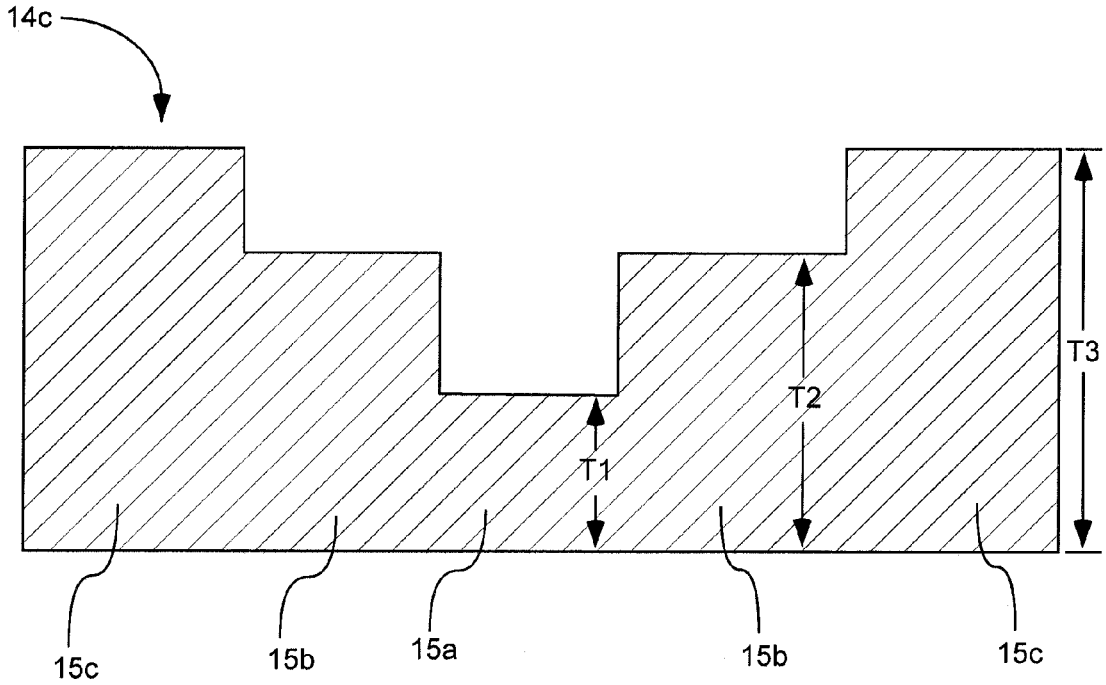
FIG. 8 is a schematic cross-sectional side view of a multiple thickness target in accordance with an embodiment of the present invention.

As shown in FIGS. 5 and 6, the outer region 15*b* can substantially circumscribe the inner region 15*a*. Although both the outer region and the inner region shown are circular in shape, the target can also be other shapes, such as oval, square, rectangular, triangle, polygonal, etc. The inner region can have a thickness T1 that is different from a thickness T2 of the outer region. As shown in FIG. 6, the inner region can be thinner and the outer region can be thicker. Alternatively, as shown in FIG. 7, the target 14*b* can have the inner region be thicker and the outer region be thinner. As shown in FIG. 8, a target 14*c* can have more than two thicknesses. Although the target 14*c* in FIG. 8 is thickest in the outermost region 15*c*, thinner in the next inner adjacent region 15*b*, and thinnest in the innermost region 15*a*, alternative arrangements of thicknesses may be utilized, such as having the thinner region as the outermost region 15*c* and the thickest region as the innermost region 15*a*. A target may include more than the three different thicknesses shown in FIG. 8. A target with more than two thicknesses can allow target thickness to be optimized at more than two tube voltages.

Figure 9:
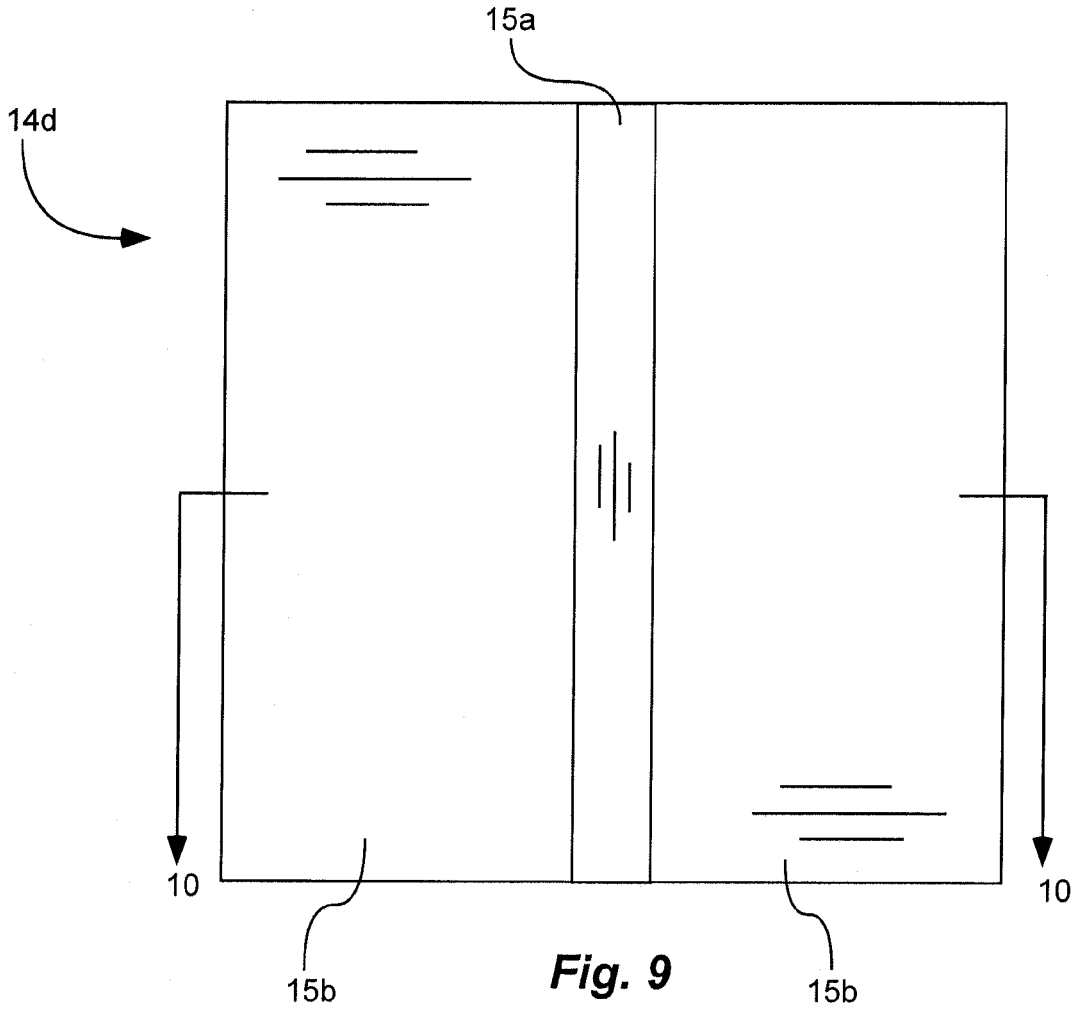
FIG. 9 is a schematic top view of a multiple thickness target in accordance with an embodiment of the present invention.
Figure 10:
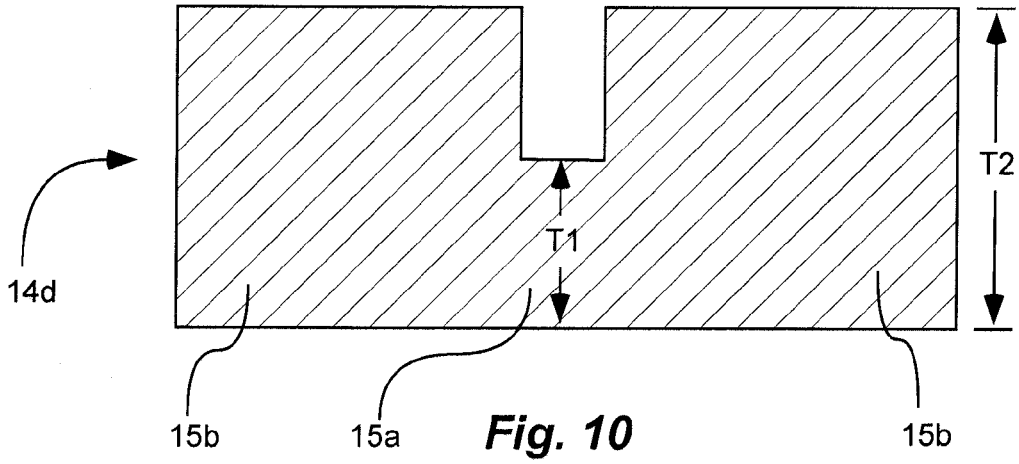
FIG. 10 is a schematic cross-sectional side view of the multiple thickness target of FIG. 9 taken along line 10-10 in FIG. 9.

The inner region 15*a* of target 14*d*, shown in FIGS. 9 and 10 is in the shape of a channel. The thicker region 15*b* is disposed on both sides of the inner region 15*a* but does not necessarily circumscribe the inner region. The electron beam can be narrowed to impinge primarily on the inner region 15*a* and expanded to impinge mostly on the outer region 15*b* of the target. Although the inner region 15*a* of target 14*d* is thinner than the outer region 15*b*, the opposite configuration may be used in which the inner region 15*a* is thicker than the outer region 15*b*. Also, there could be more than two thicknesses of target material, as was described previously regarding target 14*c*. Target 14*d* may be beneficial if the region where the electron beam impinges on the target is more linear in shape rather than circular.

In the embodiments previously described, if the inner region 15*a* is thinner, then the electron beam can be narrowed to impinge primarily upon the inner region 15*a* when a lower voltage is applied between the anode 12 and the cathode 16. The thickness T1 of the inner region 15*a* of the target 14 can be optimized for this lower voltage. This can result in a strong L-line x-ray output. The electron beam can be expanded to impinge primarily upon the outer and thicker region 15*b* when a higher voltage is applied between the anode 12 and the cathode 16. The thickness T2 of the outer region 15*b* of the target 14 can be optimized for this higher voltage. This can result in a strong K-line x-ray output.

Alternatively, if the inner region 15*a* is thicker, then the electron beam can be narrowed to impinge primarily upon the inner region 15*a* when a higher voltage is applied between the anode 12 and the cathode 16. The thickness T1 of the inner region 15*a* of the target 14 can be optimized for this higher voltage. This can result in a strong K-line x-ray output. The electron beam can be expanded to impinge primarily upon the outer and thinner region 15*b* when a lower voltage is applied between the anode 12 and the cathode 16. The thickness T2 of the outer region 15*b* of the target 14 can be optimized for this lower voltage. This can result in a strong L-line x-ray output.

Means for Expanding and Narrowing the Electron Beam

The means for expanding and narrowing the electron beam can be a magnet 20 as shown in FIG. 1. The magnet 20 can be a permanent magnet. The permanent magnet can cause the electron beam 21 to narrow when the permanent magnet is in close proximity to the anode. The electron beam 21 can expand when the permanent magnet is moved away from the anode.

The magnet 20 can be an electromagnet. The electromagnet can be annular and can surround the anode. For example, see U.S. Pat. No. 7,428,298 which is incorporated herein by reference. The electromagnet can include additional electron beam optics for further shaping the electron beam. The electrical current through the electromagnet can be adjusted, or turned on or off, to cause the electron beam to narrow or expand.

Figure 11:
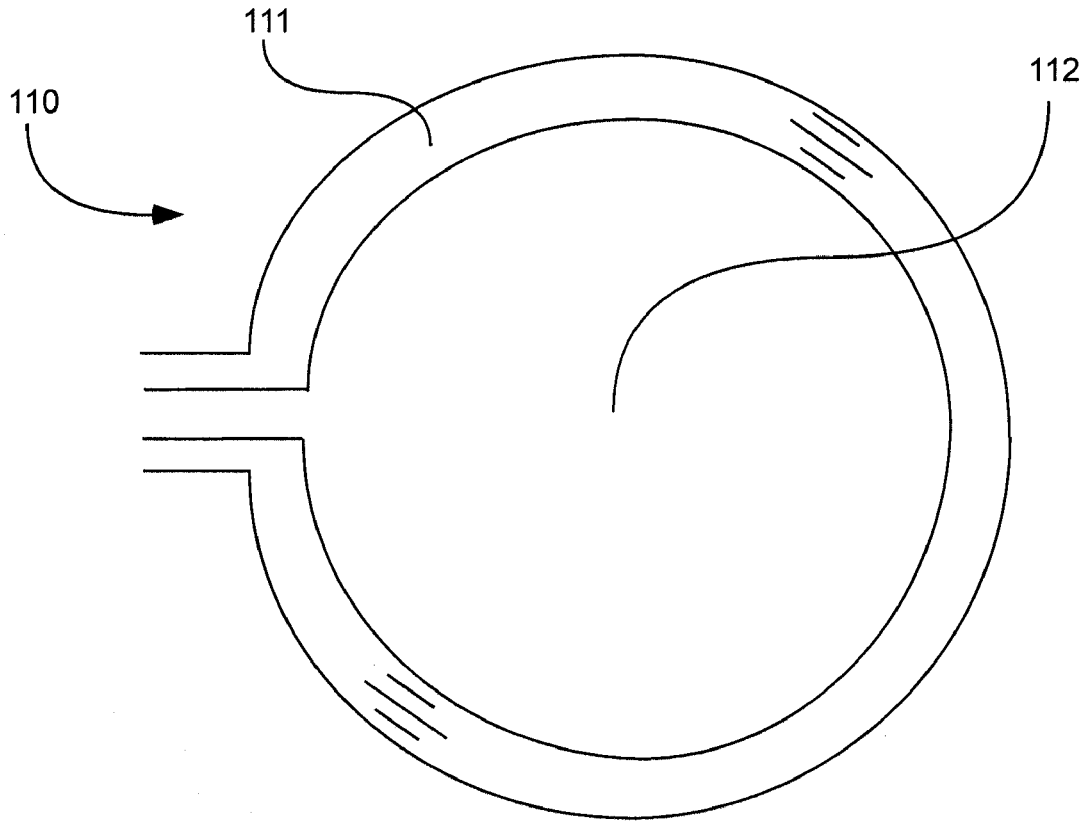
FIG. 11 is a schematic top view of a cathode filament in accordance with an embodiment of the present invention.
Figure 12:
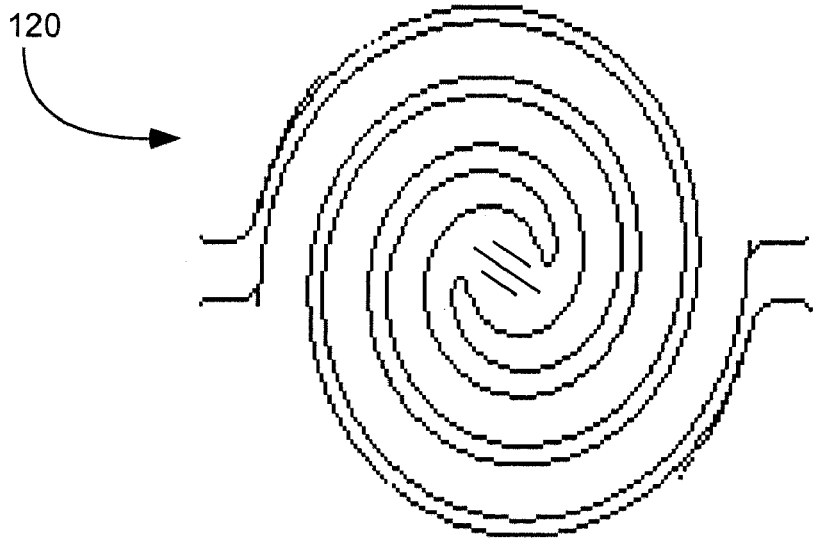
FIG. 12 is a schematic top view of a cathode filament in accordance with an embodiment of the present invention.

The means for expanding and narrowing the electron beam, and the electron source 17, can be at least one cathode filament. The filament can be resistively heated or laser heated. For example, both filaments 110 of FIG. 11 and filament 120 of FIG. 12 can be used. Filament 110 includes an outer region 111 and an empty inner region 112. Due to the shape of the filament 110, an electron beam emitted from this filament can impinge primarily on an outer portion of the target. Although filament 110 is circular in shape, this filament could be other shapes depending on the shape of the outer region 15*b* of the target 14. Filament 120 (of FIG. 12) can be placed in the empty inner region 112 of filament 110 (of FIG. 11). Filament 120 (FIG. 12) can emit an electron beam that is narrow and stronger in the center.

For example, if target 14*a* of FIGS. 5 and 6 is used with filaments 110 and 120 (FIGS. 11 and 12), an electrical current can be passed through filament 120 when a lower voltage is applied between the cathode 15 and the anode 12, thus causing a narrow electron beam to impinge primarily on the inner, thinner portion 15*a* of the target 14*a*. An electrical current can be passed through filament 110 when a higher voltage is applied between the cathode 15 and the anode 12, thus causing a wider electron beam to impinge primarily on the outer, thicker portion 15*b* of the target 14*a*.

Figure 13:
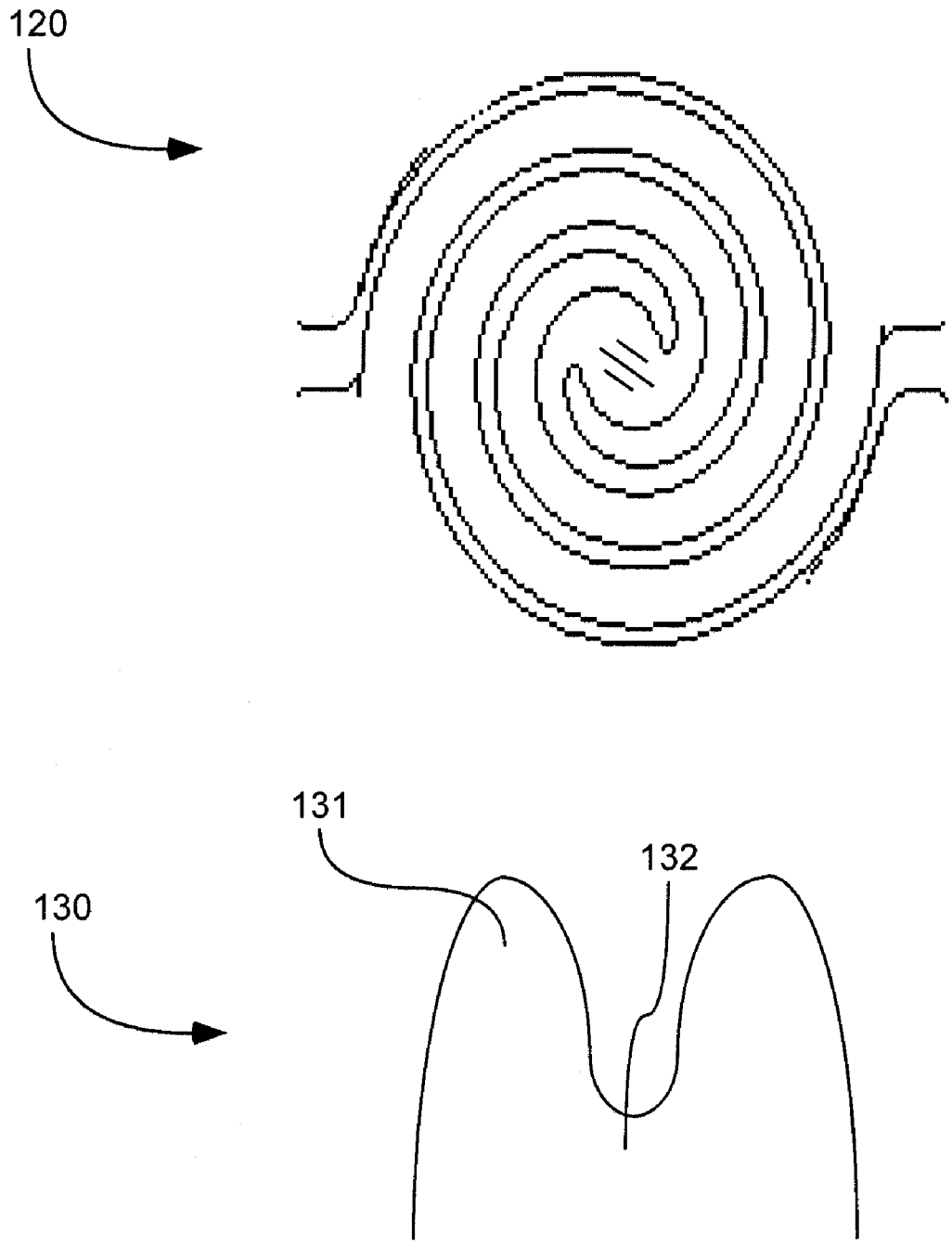
FIG. 13 is a schematic top view of a cathode filament and a laser beam intensity profile in accordance with an embodiment of the present invention.

A laser 19, shown in FIG. 1, can be used to selectively heat sections of a filament, such that the emitted electron beam can be more intense in the center or on the edges, corresponding to the desired section of the target. The laser 19 in FIG. 1 is an optional addition to the embodiment shown in FIG. 1. The electron source 17 in FIG. 1 can be a filament which may be resistively heated rather than laser heated. Laser heated cathodes are described in U.S. Pat. No. 7,236,568, which is incorporated herein by reference. The filament can be a planar filament. Planar filaments are described in U.S. patent application Ser. No. 12/407,457, which is incorporated herein by reference. For example, filament 120 is shown in FIG. 13 along with a cross sectional laser beam intensity profile 130. The laser beam profile 130 is most intense at an outer perimeter 131 of the laser beam and less intense at a center of the laser beam 132. This can result in a more intense laser beam heating the outer perimeter of the filament, causing an electron beam profile to be emitted from the filament 120 that is similar in shape to the laser beam profile—stronger at an outer perimeter and less intense at the center, thus the electron beam would impinge primarily upon outer region 15*b* of the target and less upon the center 15*a* of the target.

Figure 14:
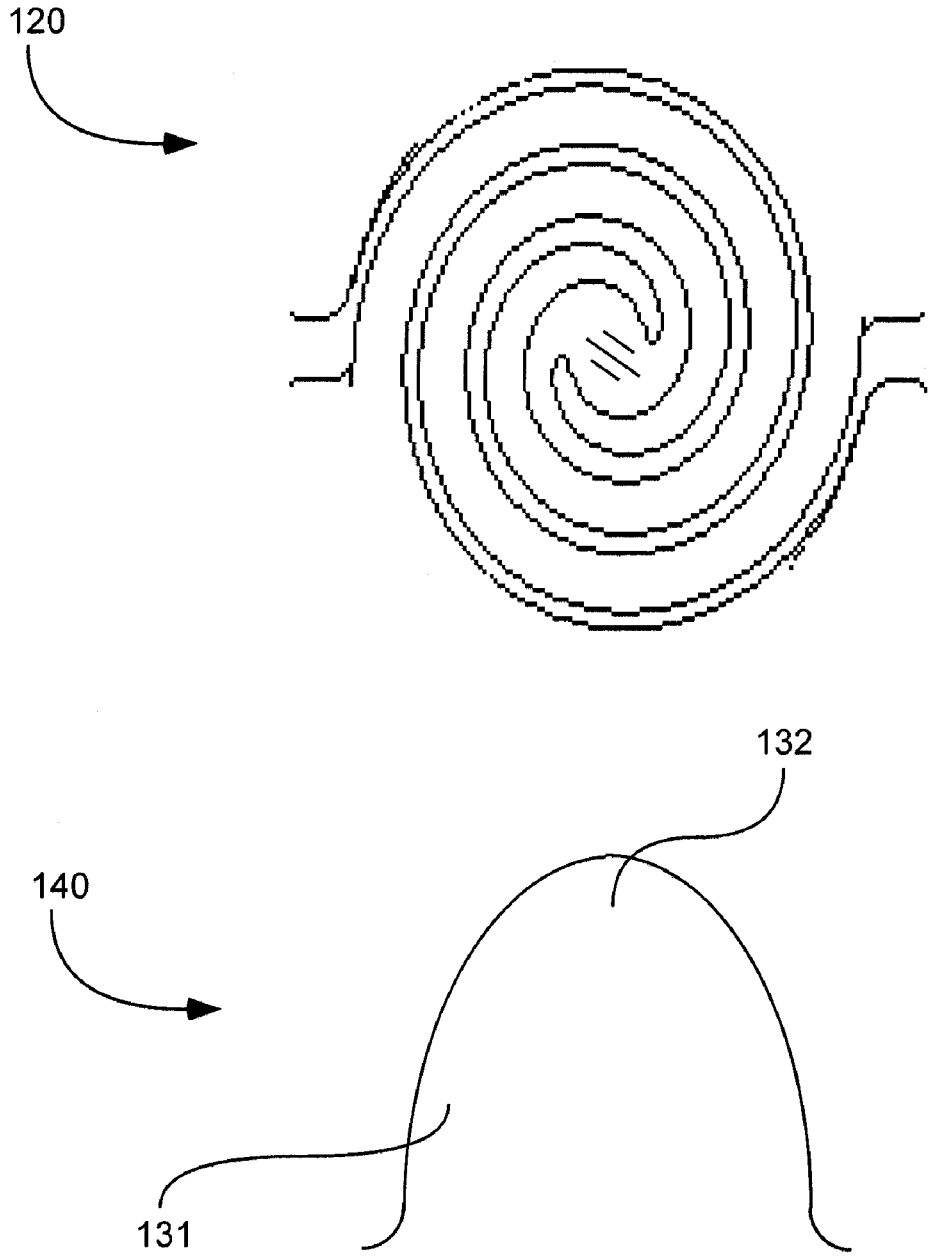
FIG. 14 is a schematic top view of a cathode filament and a laser beam intensity profile in accordance with an embodiment of the present invention.

By changing the laser beam to a different transverse electromagnetic mode, such as TEM00, the laser beam can be more intense in the center 132 and less intense at the outer perimeter 131 as shown in laser beam intensity profile 140 of FIG. 14. This can result in a more intense laser beam heating the inner region of the filament 120, causing an electron beam profile to be emitted from the filament 120 that is similar in shape to the laser beam profile—stronger at the center and less intense at the outer perimeter, thus the electron beam would impinge primarily upon an inner region 15*a* of the anode target and less upon the outer region 15*b* of the anode target.

Figure 15:
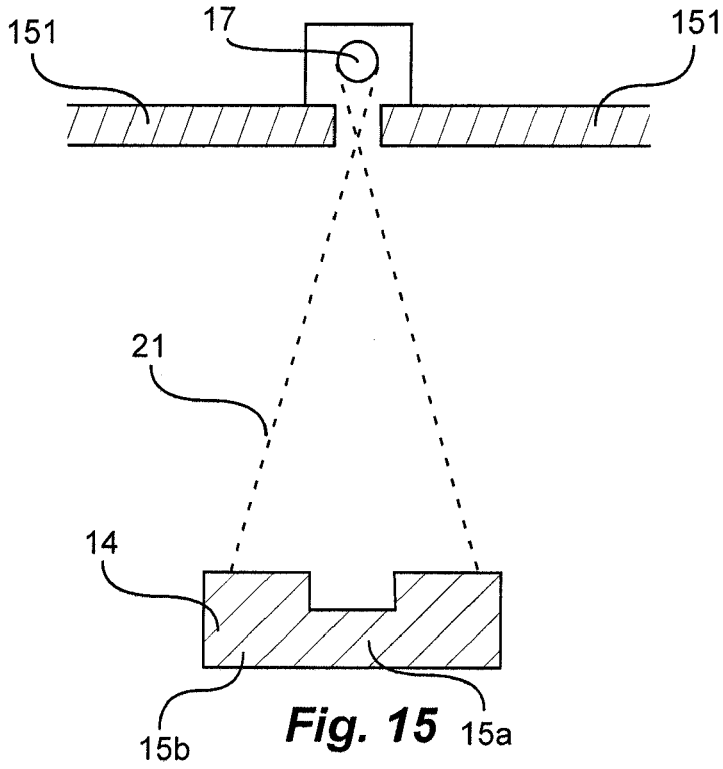
FIG. 15 is a schematic cross-sectional side view of a multiple wavelength x-ray source in accordance with an embodiment of the present invention.
Figure 16:
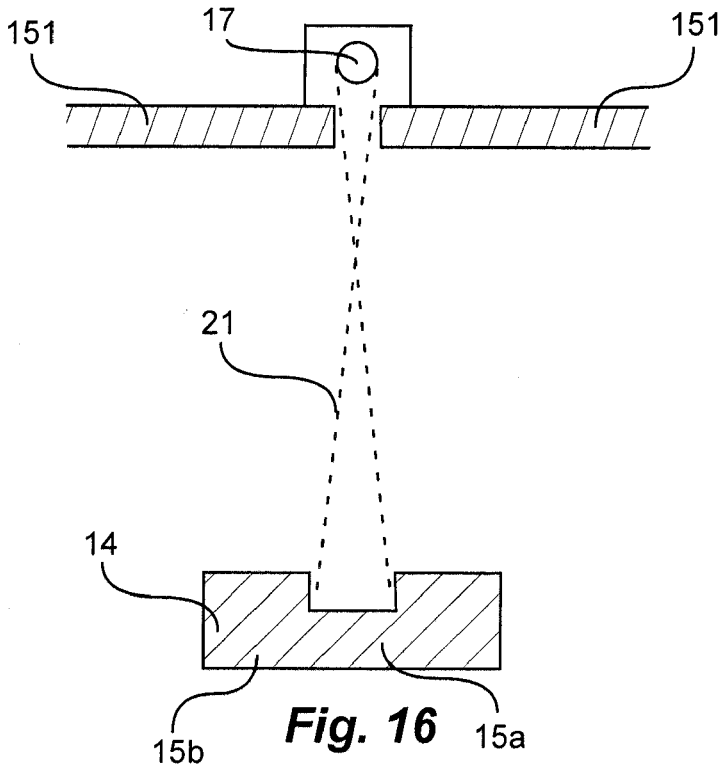
FIG. 16 is a schematic cross-sectional side view of a multiple wavelength x-ray source in accordance with an embodiment of the present invention.

The means for expanding and narrowing the electron beam can be electron beam optics combined with changes in tube voltage. The electron beam optics can be designed so that the electron beam will be narrow when a lower voltage is applied across the tube and the electron beam expands when a higher voltage is applied across the tube. Alternatively, the electron beam optics can be designed so that the electron beam will be narrow when a higher voltage is applied across the tube and the electron beam expands when a lower voltage is applied across the tube. For example, shown in FIGS. 15 and 16, cathode optics 151 can cause the electron beam 21 to be narrow upon application of one voltage applied between the anode 12 and the cathode 16 and to expand upon application of a different voltage applied between the anode 12 and the cathode 16.

Figure 17:
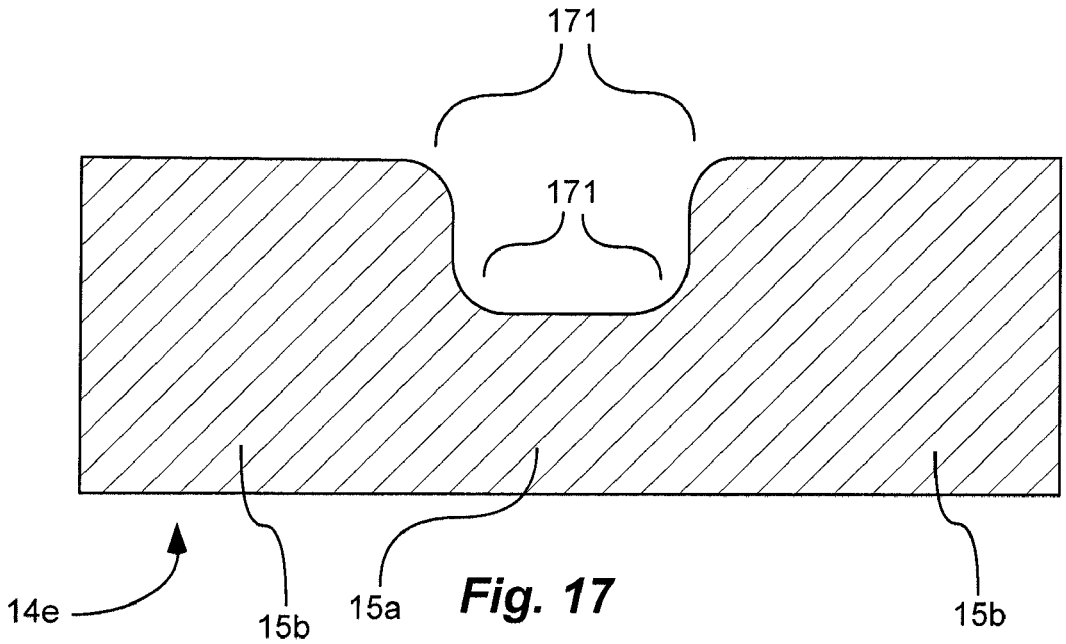
FIG. 17 is a schematic cross-sectional side view of a multiple thickness target in accordance with an embodiment of the present invention.
Figure 18:
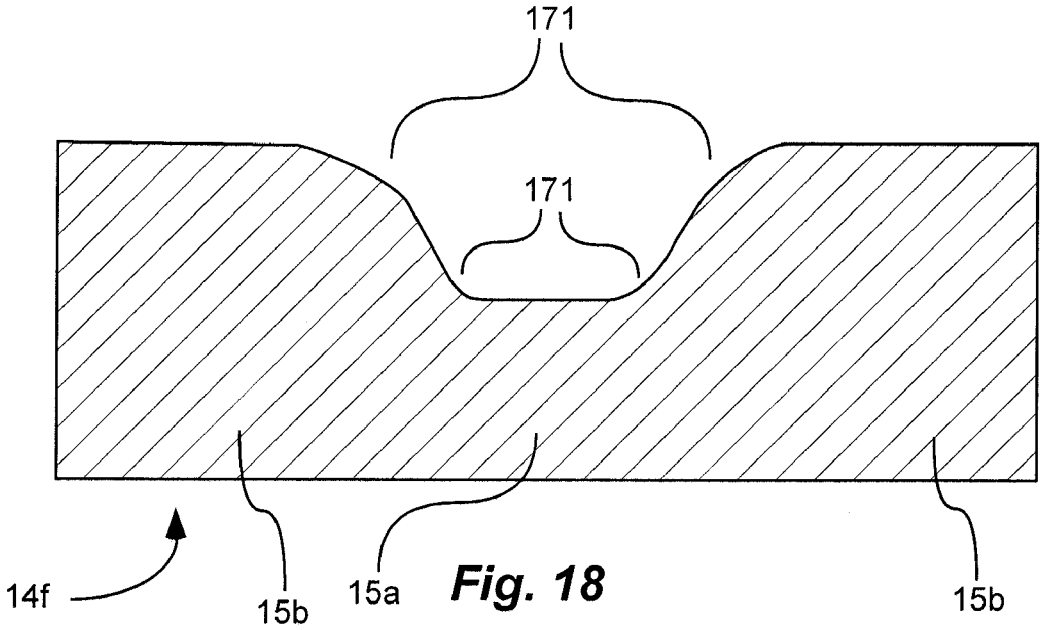
FIG. 18 is a schematic cross-sectional side view of a multiple thickness target in accordance with an embodiment of the present invention.

The targets shown previously have abrupt changes between the thicker and thinner regions. Targets 14*e* and 14*f*, shown in FIGS. 17 and 18, have gradual transitions 171 between the thicker and thinner regions. All invention embodiments can have either abrupt or gradual transitions in target thickness.

How to Make

A standard target for an x-ray tube may be patterned and etched to create at least one thinner region. The target can be made of standard x-ray tube target materials, such as rhodium, tungsten, molybdenum, gold, silver, or copper, that can emit x-rays in response to an impinging electron beam. The target material can be selected such that the L and/or K lines of the target have a higher energy, and relatively close in energy, to a K-line or an L-line in the sample. The target can be made of a single material.

Various target shaped regions, with abrupt or gradual changes in thickness can be created by various patterning and isotropic etch and anisotropic etch procedures. U.S. patent application Ser. No. 12/603,242 describes creating various shaped cavities by various patterning and etch procedures. Such procedures may be applicable in creating various shaped targets. U.S. patent application Ser. No. 12/603,242 is incorporated herein by reference.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. An x-ray source device, comprising:

a) an evacuated tube;

b) an anode coupled to the tube and including a window and a target;

c) the target having a material configured to produce x-rays in response to impact of electrons;

d) a cathode coupled to the tube opposing the anode and including at least one electron source configured to produce electrons accelerated towards the target in response to an electric field between the anode and the cathode, defining an electron beam;

e) the target having an outer thicker region and an inner thinner region; and f) a means for expanding and narrowing the electron beam while maintaining a center of the electron beam in substantially the same location, wherein the means for expanding and narrowing the electron beam:

i) narrows the electron beam to impinge mostly upon the thinner inner region of the target when a lower voltage is applied across the cathode and the anode; and ii) expands the electron beam to impinge upon the thicker outer region of the target when a higher voltage is applied across the cathode and the anode.

2. A device as in claim 1, wherein the target comprises a single material.

3. A device as in claim 1, wherein the means for expanding and narrowing the electron beam comprises:

a) a first filament adapted for projecting an electron beam that is stronger on an outer perimeter of the beam than at a center of the beam; and b) a second filament adapted for projecting an electron beam that is stronger in a center of the beam than at an outer perimeter of the beam.

4. A device as in claim 3, wherein the first filament and the second filament are planar filaments.

5. A device as in claim 1, wherein the means for expanding and narrowing the electron beam comprises electron beam optics.

6. A device as in claim 1, wherein the means for expanding and narrowing the electron beam comprises:

a) at least one electromagnet, associated with the tube, and adapted for affecting the electron beam;

b) the at least one electromagnet causing the electron beam to narrow in response to an increased electrical current through the at least one electromagnet; and c) the at least one electromagnet causing the electron beam to expand in response to a decreased electrical current through the at least one electromagnet.

7. A device as in claim 1, wherein the means for expanding and narrowing the electron beam comprises at least one permanent magnet movable with respect to the evacuated tube to cause the electron beam to narrow and expand based on proximity of the magnet to the electron beam.

8. A device as in claim 1, wherein the means for expanding and narrowing the electron beam comprises:

a) a planar filament;

b) at least one laser adapted for heating the planar filament in order to cause the planar filament to emit electrons;

c) the at least one laser being adapted to direct a laser beam towards the filament that is stronger in a center of the laser beam than at a perimeter of the laser beam to form a narrower electron beam; and d) the at least one laser being adapted to direct another laser beam towards the filament that is weaker in a center of the laser beam than at the perimeter of the laser beam to form an electron beam that is stronger at an outer perimeter of the electron beam than at a center of the electron beam.

9. A device as in claim 1, wherein the outer region of the target substantially circumscribes the inner region of the target.

10. A method of producing multiple wavelengths of x-rays from a single target, the method comprising:

a) narrowing an electron beam to impinge primarily upon a central portion of the target for producing mostly x-rays of a first wavelength; and b) expanding the electron beam to impinge primarily upon an outer portion of the target for producing mostly x-rays of a second wavelength.

11. The method of 10, wherein the target has an outer region circumscribing an inner region; and wherein the outer region has a different thickness than the inner region.

12. The method of claim 11 wherein the central portion of the target comprises a thinner region and the outer portion of the target comprises a thicker region.

13. The method of claim 11 wherein the central portion of the target comprises a thicker region and the outer portion of the target comprises a thinner region.

14. An x-ray source device, comprising:

a) an evacuated tube;

b) an anode coupled to the tube and including a window and a target;

c) the target having a material configured to produce x-rays in response to impact of electrons;

d) a cathode coupled to the tube opposing the anode and including at least one electron source configured to produce electrons accelerated towards the target in response to an electric field between the anode and the cathode, defining an electron beam;

e) the target having an thinner outer region and an thicker inner region; and f) a means for expanding and narrowing the electron beam while maintaining a center of the electron beam in substantially the same location, wherein the means for expanding and narrowing the electron beam:

i) narrows the electron beam to impinge mostly upon the thicker inner region of the target when a higher voltage is applied across the cathode and the anode; and ii) expands the electron beam to impinge upon the thinner outer region of the target when a lower voltage is applied across the cathode and the anode.

15. A device as in claim 14, wherein the target comprises a single material.

16. A device as in claim 14, wherein the means for expanding and narrowing the electron beam comprises:

a) a first filament adapted for projecting an electron beam that is stronger on an outer perimeter of the beam than at a center of the beam; and b) a second filament adapted for projecting an electron beam that is stronger in a center of the beam than at an outer perimeter of the beam.

17. A device as in claim 16, wherein the first filament and the second filament are planar filaments.

18. A device as in claim 14, wherein the means for expanding and narrowing the electron beam comprises electron beam optics.

19. A device as in claim 14, wherein the means for expanding and narrowing the electron beam comprises:

a) at least one electromagnet, associated with the tube, and adapted for affecting the electron beam;

b) the at least one electromagnet causing the electron beam to narrow in response to an increased electrical current through the at least one electromagnet; and c) the at least one electromagnet causing the electron beam to expand in response to a decreased electrical current through the at least one electromagnet.

20. The device of claim 14, wherein the outer region of the target substantially circumscribes the inner region of the target.

21. A device as in claim 14, wherein the means for expanding and narrowing the electron beam comprises:

a) a planar filament;

b) at least one laser adapted for heating the planar filament in order to cause the planar filament to emit electrons;

c) the at least one laser being adapted to direct a laser beam towards the filament that is stronger in a center of the laser beam than at a perimeter of the laser beam to form a narrower electron beam; and d) the at least one laser being adapted to direct another laser beam towards the filament that is weaker in a center of the laser beam than at the perimeter of the laser beam to form an electron beam that is stronger at an outer perimeter of the electron beam than at a center of the electron beam.

* * * * *